United States Patent [19]

Lubeck

[11] Patent Number: 4,705,274

[45] Date of Patent: Nov. 10, 1987

[54] RETRACTABLE SEAT FOR GAMING DEVICES

[75] Inventor: Joseph G. Lubeck, Unionville, Pa.

[73] Assignee: Laureate Innovations, Inc., Dover, Del.

[21] Appl. No.: 937,046

[22] Filed: Dec. 2, 1986

Related U.S. Application Data

[62] Division of Ser. No. 715,646, Mar. 25, 1985, Pat. No. 4,657,257.

[51] Int. Cl.[4] ..... A63B 71/00; A47C 1/02; A47G 29/02

[52] U.S. Cl. ..... 273/148 R; 273/148 B; 297/332; 248/240.4

[58] Field of Search ..... 273/148 R, DIG. 28; 297/332, 331; 248/240.1, 240.4

[56] References Cited

U.S. PATENT DOCUMENTS

| | | | |
|---|---|---|---|
| 297,982 | 5/1884 | Francis . | |
| 567,320 | 9/1896 | Milner . | |
| 588,798 | 12/1901 | Steinbach . | |
| 695,426 | 4/1901 | Brockett | 297/332 |
| 1,106,693 | 8/1914 | Von Wranan . | |
| 1,394,036 | 10/1921 | Main . | |
| 1,395,757 | 10/1915 | McWhirter | 297/334 |
| 1,458,628 | 6/1923 | Pardy . | |
| 2,625,984 | 1/1951 | Schweikert | 248/240.4 |
| 2,635,675 | 4/1953 | Buck . | |
| 2,815,064 | 12/1957 | Witzel . | |
| 2,860,690 | 11/1954 | Small | 248/240.4 |
| 3,033,614 | 5/1962 | Pazan . | |

*Primary Examiner*—Richard C. Pinkham
*Assistant Examiner*—Gary Jackson
*Attorney, Agent, or Firm*—Limbach, Limbach & Sutton

[57] ABSTRACT

Retractable seats are described for use with discrete, free-standing gaming devices. A support arm is fastened at one end to a vertical standing surface. The gaming seat is positioned at the distal end of the support arm and can be selectively positioned in the horizontal or vertical positions. In all embodiments, a spring loaded pneumatic cylinder is used to retract the support arm from its extended position in front of the gaming device.

Three different embodiments of the support arm and gaming seat are disclosed. The first embodiment comprises a support arm having one section only which rotates about a pivotal fastener between the horizontal and vertical position. The second embodiment comprises a support arm having a plurality of sections with generally rectangular cross-sections, consecutive sections sized to be received within each other. In this embodiment, retraction occurs along the longitudinal axis of the support arm. The third embodiment has support arm sections having circular cross-sections. Retraction along the longitudinal axis is accomplished through a spring loaded pneumatic device. Means for locking the sections in an extended position is disclosed.

28 Claims, 9 Drawing Figures

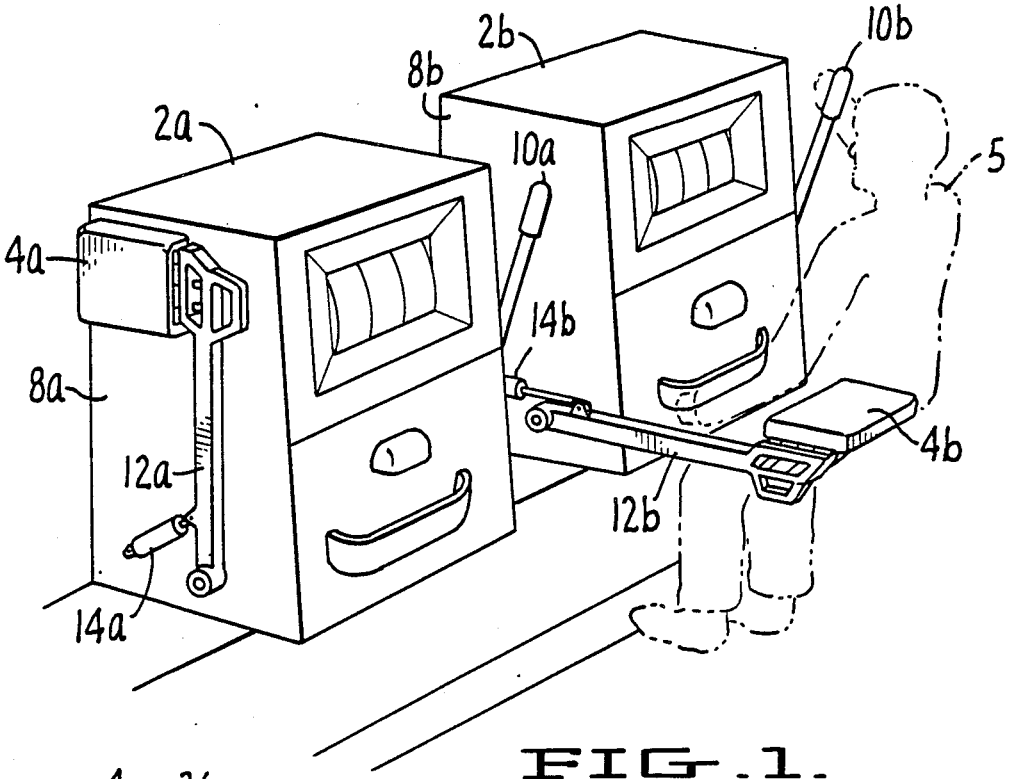
FIG. 1.
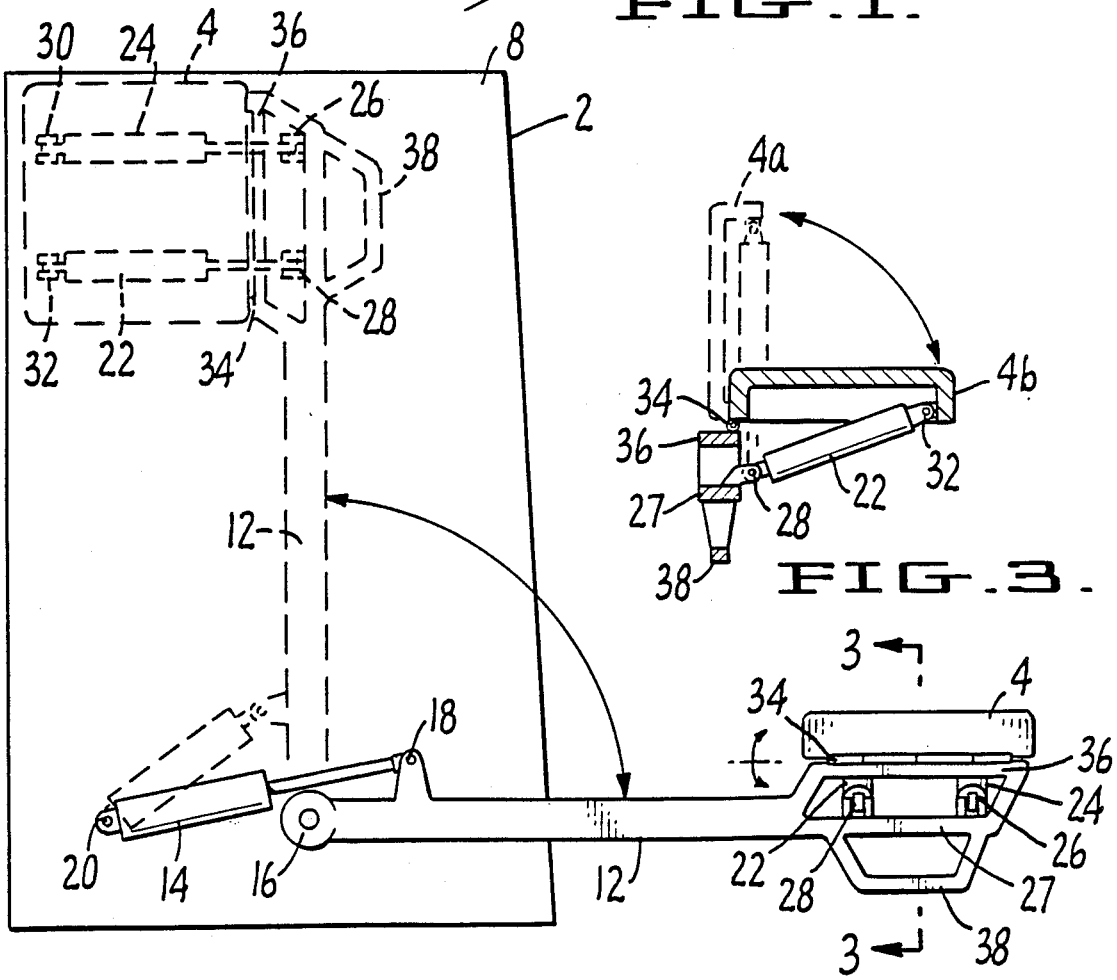
FIG. 2.
FIG. 3.

RETRACTABLE SEAT FOR GAMING DEVICES

This is a division of application Ser. No. 715,646, filed Mar. 25, 1985, now U.S. Pat. No. 4,657,257.

DESCRIPTION

1. Technical Field

This invention generally relates to a seating device which retracts. More specifically, this invention relates to a seating device attached to a gaming device, which will retract into very small spaces, leaving the floor area clear in front of the gaming device.

2. Background

Video game arcades and casinos densely pack their gaming machines side by side, in rows, to maximize the revenue generated per square foot of floor space. The spaces between machines are minimized to permit the largest number of machines in one row. The spaces between rows of machines are often set by local fire codes to provide safe egress from the casino or arcade under emergency conditions. Thus any seat or stool placed in the aisles is likely to present safety hazards if it cannot be easily retracted to clear the aisles in case of fire or other emergency.

Time and motion studies, however, suggest that gaming device users tend to spend a longer period of time at such devices if the player can be seated comfortably to rest his/her feet. This creates a conflict between safety on one hand and user satisfaction on the other.

The problem of providing seats while maintaining clear floor space when the seats are not in use is the subject of several prior art references. In U.S. Pat. No. 297,982 (May 6, 1884), a folding counter seat that can be operated from either side of the counter via treadle and rod is disclosed. The counter seat is mainly supported by one vertical leg and two supports which approach the seat at an acute angle. When retracted, the angled supports move into the perpendicular position, the seat folds back over the leg and the supports, and the device stores under the lip of the counter. Although useful for counters having an extension or overhang, this device would not provide a free space in front of a vertical standing surface without an overhang.

U.S. Pat. No. 567,320 (Sept. 8, 1896) discloses an automatic acting stool. The claimed combination comprises a floor bracket, a curved leg and a round stool. The stool and floor bracket are spring loaded so that they will automatically retract when not in use. However, this device is incapable of providing free floor space in front of a vertical standing surface. It, too, is more useful in the bar/counter setting.

An improvement over the spring loaded action of the automatic acting stool is claimed in U.S. Pat. No. 588,798 (Dec. 10, 1901); a counterweight is disclosed as means for automatically retracting stools. This is purported to be a marked improvement over spring-activated stools whose utility declines because of the spring's failure to act over time. This device, even more so than the previous two stools, occupies a considerable amount of floor space in front of a vertical standing surface, thereby limiting its utility to bar/counter settings.

A different approach to the space limitation problem is presented in U.S. Pat. No. 2,625,984 (Jan. 20, 1953), which discloses a disappearing chair, recessed within a front vertical standing surface. The seat is fixed to the end of a pair of supports and can be pulled out of the recess against the force of a spring and cylinder. The supports rotate about an axis; in the recessed position the support are at approximately 90 degrees to horizontal. The "in use" position is approximately 45 degrees. When the user vacates the stool, it is drawn back into the recess, concealing the unit within the counter face. Although this unit leaves a free floor space, it requires a recess in the vertical standing surface. In the case of gaming devices this presents a problem due to interference with the electrical and mechanical components inside the unit.

The subject invention is specifically designed for use in conjunction with gaming devices. The prior art concerns itself with a continuous counter or bar surface. This setting comprises two surfaces, the counter top (a horizontal surface) and the support surface (a vertical surface). Stools or chairs must be fastened to the support surface or the floor. Gaming devices, however, are not continuous. Rather, each gaming device is discrete, having three available vertical faces. Further, each unit is spaced apart from those units adjacent to it. This space is required for "gaming purposes," access for repair comfort of the user, etc.

The subject invention is necessarily adapted to this discrete arrangement of gaming devices. It departs from the prior art in that the surface to which the seating device is attached is not the vertical surface facing the user. Instead, the gaming seat is supported by another vertical surface, essentially one side of the gaming device. Thus, the spacial relationship between the gaming device, the seat and its supporting structure permits retraction to the side of the gaming device, leaving a free floor space in front of the machine. The subject invention differs from the prior art in that the physical forces must be translated through a different geometry, i.e., the plane in which the forces act and react in the subject invention is perpendicular to the plane of reaction of the prior art. The change in geometry permits designs which are not possible in the counter/bar setting.

It is therefore an object of this invention to provide a retractable seat to be used in connection with gaming devices.

It is a further object of this invention to provide a seat which automatically retracts when the user leaves.

It is yet another object of this invention to provide an automatically retracting seat which will leave the space in front of the gaming device free and clear, thereby enhancing safe egress by the user under emergency conditions, as well as providing the user with an option not to use the seat.

It is an object of this invention to provide a retractable gaming seat which is simple to use.

It is a further object of this invention to provide a retractable gaming seat which is simple to install.

SUMMARY OF INVENTION

The retractable gaming seat device which is the subject of this invention is fastened to the side of a gaming device, and is selectively moved from the retracted position at the side of the gaming device, to the extended position, in front of the gaming device. All embodiments of the retractable gaming device consist of a support arm attached at one end to the side of the gaming device, a seat at the free end of the support arm and means for retracting the support arm to the side of the gaming device. The seat at the free end of the support arm can be selectively positioned in either the vertical position or the horizontal position, depending on whether the support arm is in the retracted or extended position.

In one embodiment of the invention, a pneumatic cylinder is used to swing the support arm through an arc of 90 degrees. The retracted position is substantially vertical and the extended position of the support arm is essentially horizontal. Pneumatic cylinder means is used to retract the support arm from its extended position, once the user leaves the seat.

In another embodiment of the invention, the support arm consists of a plurality of sections having substantially rectangular cross-sections. The sections are consecutively sized, with the largest cross-section being fastened to the side of the gaming device. In the retracted position, the sections of the support arm are received within each other. The seat is turned to the vertical position and stored at the side of the gaming device. In the extended position, the support arm sections are moved along the longitudinal axis of the support arm and the seat then is rotated to the horizontal position. The automatic retracting means in this embodiment comprises a spring and pneumatic cylinder to draw a distal end of the support arm towards its fixed end.

In yet another embodiment of the retractable gaming seat, the support arm consists of a plurality of circular cross-sectional pieces. These pieces are sized to permit consecutive sections to be received within each other. This embodiment also reaches its extended position by the extension of the sections of the support arm. In this embodiment the seat is firmly fastened to a distal section of the support arm; rotation of the seat from the vertical to horizontal position rotates the support arm section and activates a cog-locking device, which maintains the support arm in the extended position until such time as the seat is rotated upwards by the force of a spring placed in the annular space between support arm sections. Retracting means comprises a spring and pneumatic cylinder located at the fixed end of the support arm and attached at one end to the fixed end of the support arm and at the other end to an intermediate section of the support arm.

BRIEF DESCRIPTION OF THE DRAWINGS

FIG. 1 is a perspective view of the vertical type retractable gaming seat of the present invention in the retracted and extended positions.

FIG. 2 is a front view of the vertical type retractable gaming seat in the retracted and extended positions.

FIG. 3 is a sectional view taken along the line 3—3 in FIG. 2.

BEST MODE FOR CARRYING OUT THE INVENTION

Figure 4:
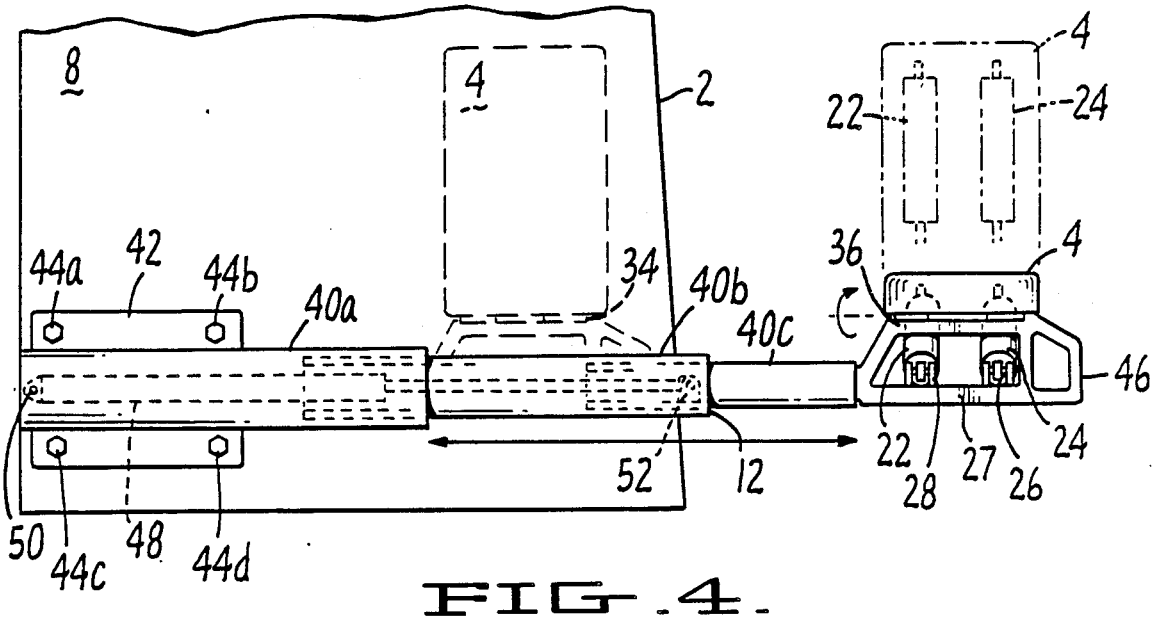
FIG. 4 is a front view of the slide arm type retractable gaming seat of the present invention.

A.

Support Arm Embodiments

1. The Overall Concept

Referring to FIG. 1, two (2) slot machines 2*a* and 2*b* are shown in a perspective view. Retractable seats, 4*a* and 4*b*, are shown in the retracted and extended positions respectively. A slot machine user 5 is seated upon the retractable gaming seat 4*b*. In this embodiment, retractable gaming seats are fastened to slot machine side surfaces 8*a* and 8*b* on the left hand side of the slot machines 2*a* and 2*b*. The right hand side surfaces (not shown in this figure) are reserved for the activation arms 10*a* and 10*b*, used to operate the slot machines. A gaming seat 4 is supported by a support arm 12*b* which extends horizontally from the slot machine side surface 8*b*. When no longer in use, the gaming seat device is automatically retracted by a spring loaded pneumatic cylinder 14. In the retracted position, the support arm 12*a* is substantially vertical and the spring loaded pneumatic cylinder 14*a* is in a compressed position.

2. Vertical Type Support Arm

The vertical type support arm embodiment is described with reference to FIG. 2. The retractable gaming seat device is positioned in a plane substantially parallel to the plane of the slot machine side surface 8, a vertical surface of the slot machine 2. The dashed lines of FIG. 2 show the device in the retracted position, the support arm 12 being substantially vertical. In the extended position, the support arm 12 is horizontal. One end of the support arm 12 is fastened to the slot machine side surface by a pivotal fastener 16. This pivotal fastener 16 permits rotation of the support arm 12 through a 90 degree arc. The pivotal fastener 16 is designed to prohibit rotation outside of this particular guadrant. The movement of the support arm 12 through the arc from the horizontal to vertical positions is made possible by the action of the spring loaded pneumatic cylinder 14. The force of this cylinder 14 is applied to the support arm 12 through a support arm tab 18 located near the fixed end of the support arm 12. The other end of the spring loaded pneumatic cylinder 14 is pivotally fastened to the slot machine side surface 8 by a pneumatic cylinder fastener 20.

The spring loaded pneumatic cylinder 14 is designed such that in its relaxed position the cylinder is compressed and there is no tension upon the spring, i.e., support arm tab 18 and pneumatic cylinder fastener 20 are closest together. When the support arm 12 is in the horizontal position, the pneumatic cylinder 14 is in an extended position; a force is required to stretch the spring inside the cylinder 14 to obtain the horizontal position.

At a distal end of the support arm 12 is the gaming seat 4. When stored in the retracted position, at the side of the slot machine 2, the seat 4 lies on a plane substantially parallel to the slot machine side surface 8. When in use however, the seat 4 must be in a position substantially perpendicular to the slot machine side surface 8. Just as the support arm 12 was designed to automatically retract, so too must the gaming seat 4 be automatically retractable from the extended position, perpendicular to the slot machine side surface 8. Selective positioning of the gaming seat 4 is accomplished through the use of two (2) additional pneumatic cylinders.

The action of these cylinders is described with reference to FIG. 2 and 3. The gaming seat 4 is fastened to the support arm 12 via a hinge 34. One face of the hinge is attached to a lower surface of the seat 4; the other face of the hinge is fastened to a support arm ledge 36. This hinge 34 is designed so as to permit rotation through the 90 degrees required to retract and extend the gaming seat 4. A first seat pneumatic cylinder 24 is fastened at one end to a first support arm tab 26, projecting from a free-end cross piece 27. The other end of the first seat pneumatic cylinder 24 is fastened to a first seat tab 30 located on the underside of gaming seat 4.

The action of the first and second seat pneumatic cylinders 22 and 24 is shown in FIG. 3. Cylinders 22 and 24 are normally extended in their relaxed position. Thus, force must be applied to cylinders 22 and 24 to compress internal springs and to maintain the seat 4*b* in the horizontal position. Once the user vacates the gaming seat 4, forces exerted by the springs contained within cylinders 22 and 24 apply force to a second seat tab 32 in the vertical direction, causing the seat 4 to rotate from the horizontal position 4*b* to the vertical position 4*a*. This rotation occurs because the seat 4 is fixed at one end by the hinge 34 to the support arm ledge 36.

As shown in FIG. 2, the support arm free end has a handle 38 below the free-end cross piece 27. The user uses the handle 38 to pull the support arm 12 down from the vertical position to the horizontal position. The handle 38 is necessary to exert force against the spring inside cylinder 14. Once the user pulls the support arm 12 from the vertical to the horizontal position, the user can use her hand to force the seat 4 from the vertical to horizontal position in front of the gaming device.

When the user leaves the gaming device and stands up, the seat 4 flips up by virtue of first and second pneumatic cylinders 22 and 24, and the arm 12 is retracted by the action of spring loaded pneumatic cylinder 14. It is important that the reaction of the spring loaded pneumatic cylinder 14 be slower than the action of the first and second seat pneumatic cylinders 22 and 24. Otherwise, the arm 12 would retract before the seat 4 had an opportunity to rotate from the perpendicular to parallel positions. This would cause the retraction of the support arm 12 to be thwarted by the seat 4 striking the slot machine gaming surface (not shown on FIG. 2).

3. The Slide Arm Type

Another embodiment of the retractable gaming seat device is shown in FIG. 4. In this embodiment, the support arm 12 is permanently positioned horizontally, on the slot machines side surface 8. The support arm 12 is divided into three separate sections 40*a*, 40*b* and 40*c*, having generally rectangular cross-sectional areas. Other embodiments within the scope of the invention may contain two, four or more sections. The sections 40*a*, 40*b* and 40*c* are consecutively sized to permit section 40*c* to be received within section 40*b* and sections 40*b* and 40*c* to be received within section 40*a*. Thus the retraction movement in this embodiment is along a horizontal line, the support arm longitudinal axis, rather than the 90 degree arc of the vertical type support arm. The support arm 12 is rigidly fastened to the slot machine side surface 8 by a fastening plate 42, secured to the slot machine side surface via hexagonal bolts 44*a*, 44*b*, 44*c* and 44*d*. This embodiment differs from the vertical type support arm in that the support arm 12 is rigidly fastened at the fastening plate 42, rather than the pivotal arrangement shown in FIG. 2. The support arm 12 does not rotate about this point. The plate 42 is designed to resist forces in the horizontal and vertical directions.

The seat end of the support arm 12 in this embodiment is similar to the configuration of the seat in the vertical type support arm. First and second seat pneumatic cylinders 22 and 24 maintain the seat 4 in the vertical position when not in use because cylinders 22 and 24 are normally extended in their relaxed position, forcing the seat 4 to rotate about the hinge 34 in a 90 degree arc. The first and second seat pneumatic cylinders 22 and 24 are fastened to a free-end cross piece 27 via first support arm tab 26 and second support arm tab 28 respectively.

Since the action of the slide arm type support arm occurs along a horizontal line rather than through a 90° quadrant, the automatic retraction mechanism differs substantially from the action of the spring loaded pneumatic cylinder 14 shown in FIG. 2. The handle 46 at the distal end of the support arm 12 is used to exert a force along the longitudinal axis of the support arm 12. Located inside the largest support arm section 40*a* near the fastening plate 42 is a slide arm spring loaded pneumatic cylinder 48 which acts to retract sections 40*b* and 40*c* from the extended position. Slide arm spring loaded pneumatic cylinder 48 is fastened to section 40*a* by a support arm tab 50 located at the fixed end of the support arm and an intermediate section tab 52 located inside of section 40*b* of the support arm 12. The slide arm spring loaded pneumatic cylinder 48 is normally compressed in the relaxed position. Therefore, when the user exerts a force along the longitudinal axis by pulling on the handle 46, tension is applied to the spring within the pneumatic cylinder 48.

Figure 8:
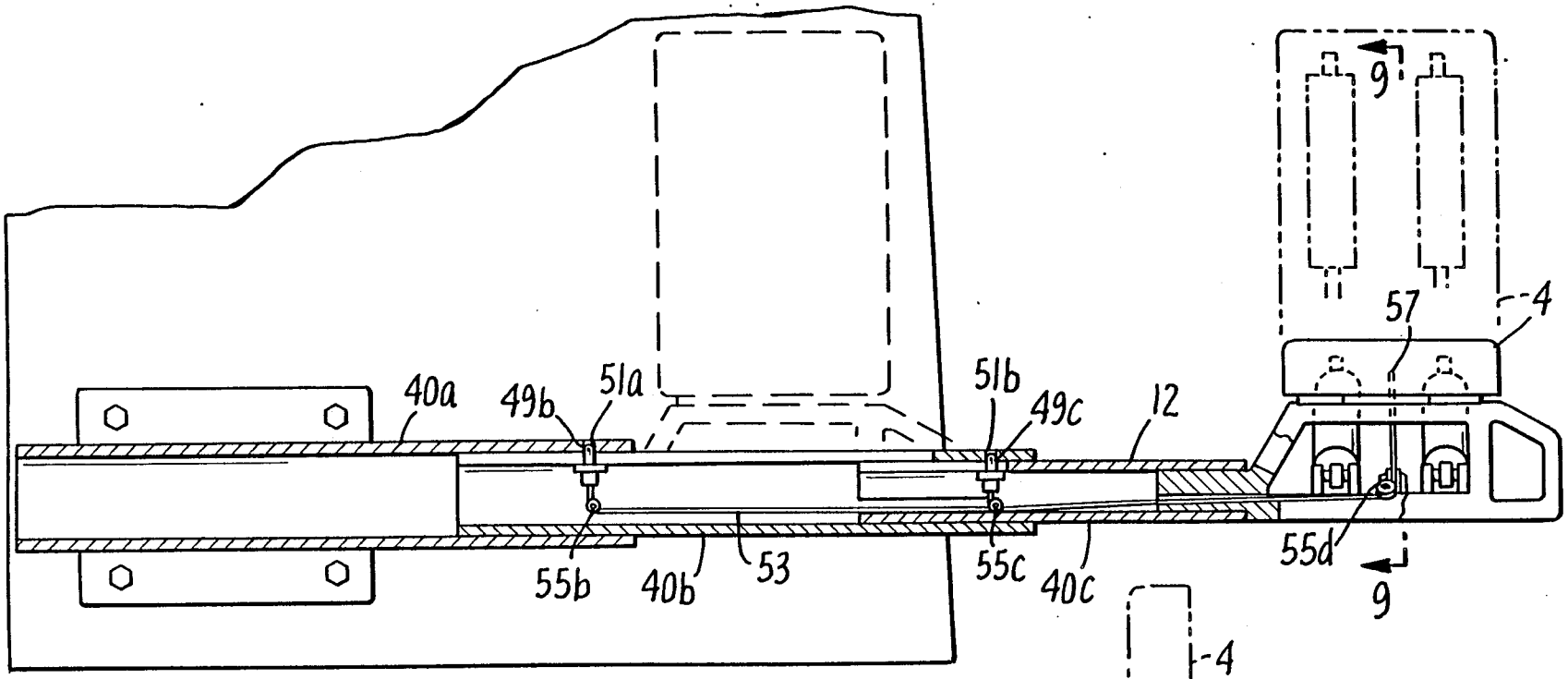
FIG. 8 is an exploded view of the linkage means and locking means utilized in the slide arm type retractable gaming seat.
Figure 9:
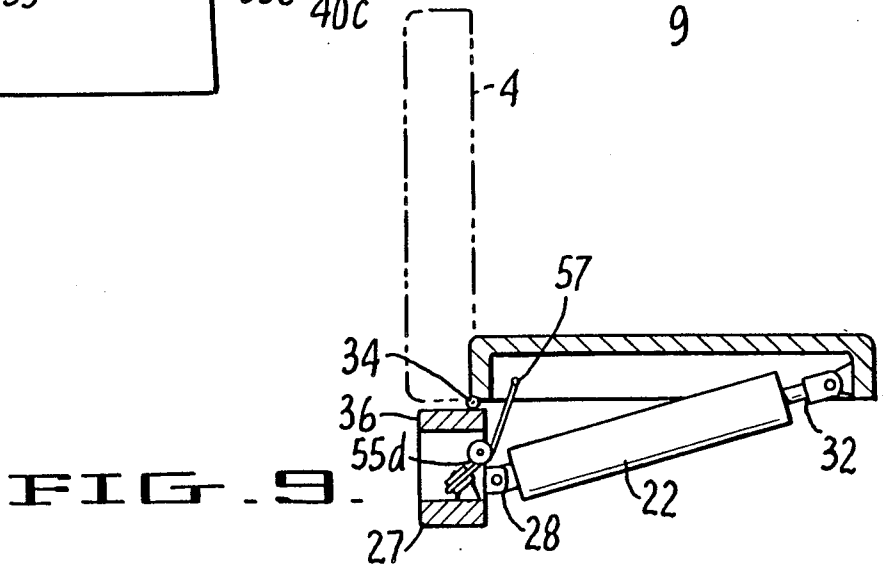
FIG. 9 is a section along the line 9—9 in FIG. 8.

In order to maintain the support arm 12 in its extended position when the gaming seat 4 is in use, a locking mechanism has been developed which is activated by the position of the seat 4. As shown in FIG. 8, located at the end of sections 40*b* and 40*c* closest to the fixed end of the support arm are spring activated pins 49*b* and 49*c*, respectively. Corresponding apertures 51*a* and 51*b* are located in sections 40*a* and 40*b*. When the support arm 12 is extended, the spring activated pins 49*b* and 49*c* push through apertures 51*a* and 51*b* respectively, preventing sections 40*b* and 40*c* from moving along the longitudinal axis of the support arm 12 and maintaining the arm 12 in fully extended position. The inner surfaces of arm sections 40*a* and 40*b* are slotted to permit travel against the pins 49*b* and 49*c*.

Spring activated pins 49*b* and 49*c* are connected to a cable 53 via rollers 55*b* and 55*c*. The other end of cable 53 is joined to a pin 57 located on the underside of seat 4. When the seat 4 rotates from the horizontal position to the vertical position, cable 53 is stretched, causing spring activated pins 49*b* and 49*c* to be pulled out of apertures 51*a* and 51*b*, permitting movement of the support arm sections 40*b* and 40*c* along the longitudinal axis of the support arm. An additional feature of this locking mechanism is that it insures that the seat 4 will return to the vertical position before the support arm 12 is retracted.

4. The Bayonet Type Support Arm

Figure 5:
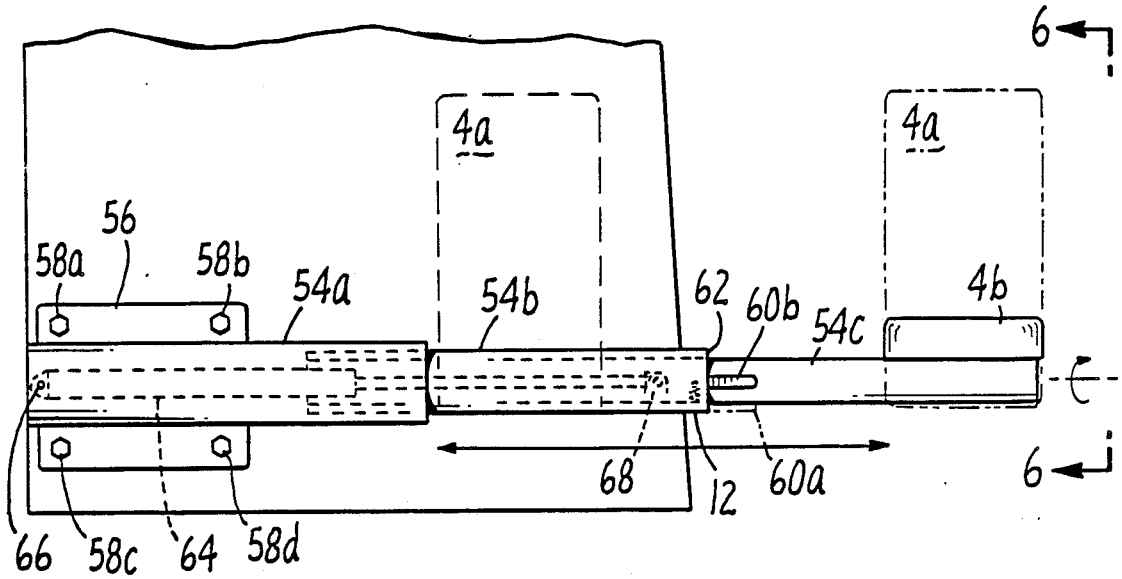
FIG. 5 is a front view of the bayonet type retractable gaming seat of the present invention.

The bayonet type support arm embodiment is shown in FIG. 5. The support arm 12 is in a plane parallel to the slot machine side surface 8 and perpendicular to the front face of the slot machine 2. This embodiment is similar to the slide arm type support arm because the retraction of the support arm 12 takes place along its longitudinal axis. The support arm 12 consists of three sections having circular cross-sections and consecutively sized to be received within each other, support arm sections 54*a*, 54*b* and 54*c*. In other embodiments of the bayonet type support arm, as few as two, and more than three, sections are intended to be within the scope of this invention. One end of the support arm 12 is affixed to the slot machine side surface 8 by a bayonet type fastening plate 56, securing one end of section 54*a*, restricting movement in both the horizontal and vertical axes. The fastening plate 56 is joined to the slot machine side surface 8 by hexagonal bolts 58*a*, 58*b*, 58*c* and 58*d*.

When retracted, the gaming seat 4 is in the vertical position shown by the dashed lines in FIG. 5. As in the other embodiments, when the gaming seat 4 is in use, it is rotated through 90 degrees to the horizontal position shown by the solid lines in FIG. 5. However, the bayonet type support arm embodiment differs from the other embodiments since rotation of the gaming seat 4 through that 90 degree arc from the vertical to horizontal positions does not necessarily entail the use of pneumatic shock devices (e.g., first and second seat pneumatic cylinders 22 and 24), nor hinges.

The bayonet type support arm takes advantage of the circular cross-section of the pieces 54*a*, 54*b* and 54*c* which permits rotation about the longitudinal axis of the support arms without the need for the hinge 34 and the support arm ledge 36.

Figure 6:
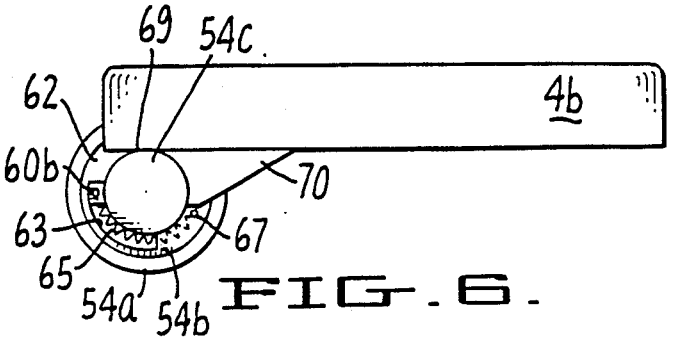
FIG. 6 is a section along the line 6—6 in FIG. 5.
Figure 7:
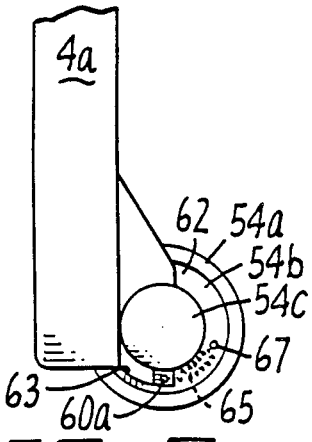
FIG. 7 is another section along the line 6—6 in FIG. 5, showing the seat in an alternate position.

FIGS. 6 and 7 show the gaming seat 4 in the horizontal (4*b*) and vertical (4*a*) positions, respectively. The gaming seat 4 is attached to one end of the support arm section 54*c*. A simple weld 69 and support member 70 are sufficient. At the other end, closest to section 54*b*, section 54*c* contains a pin 60 which interacts with a slot in a cog face 62 which is affixed to one end of support arm section 54*b* and which fills an annular space between sections 54*b* and 54*c*. Cog face 62 with its slotted quadrant restricts movement of the distal support arm section 54*c* between the horizontal and vertical positions. When the seat 4 is in the retracted position 4*a*, the pin 60*a* rests in the slot in cog face 62 approximately at the six o'clock position. When the gaming seat 4 is in the extended position 4*b*, and the seat rotated towards the horizontal position, the pin 60*b* rests in the slot in cog face 62 at approximately the nine o'clock position. This prevents the gaming seat 4 from becoming displaced while in use.

Means for maintaining the seat 4 in the vertical position when not in use is shown in FIGS. 6 and 7. Spring means 65 are located in an annular space between circular sections 54*b* and 54*c*. Spring means 65 is affixed at one end to pin 67 and at the other end to pin 60. As section 54*c* is rotated in a clockwise direction, corresponding to seat 4 moving from vertical to horizontal positions, spring means 65 is compressed. Once the user vacates the seat 4, spring means 65 provides the force required to rotate section 54*c* in a counterclockwise direction, returning seat 4 to the vertical position. Spring means 65 works in conjunction with cog face 62 to restrict movement of section 54*c* to the quadrant between the horizontal and vertical positions.

Referring again to FIG. 5, at the fixed end of the support arm 12 is bayonet spring loaded pneumatic cylinder 64 supported at one end by a bayonet support arm tab 66 and at the other end by an intermediate bayonet section tab 68. Pneumatic cylinder 64 provides the force required to automatically retract the support arm sections 54*a*, 54*b* and 54*c* when fully extended. The pneumatic cylinder 64 is normally in a compressed position when relaxed. The locking means and release linkages which permit the automatic retraction of the support arm 12 in the slide arm type support arm embodiment (see FIG. 8) can be adapted to the bayonet type support arm.

B.

Other Use Environments

Although the foregoing embodiments have been described with reference to a particular gaming device, namely slot machines, it is recognized that this invention is not limited to gaming devices which are slot machines. The subject invention is useful in such gaming devices where a display face, having either video or mechanical display means is located between, and connected to, standing support surfaces such as slot machine side surface 8 in the foregoing embodiments. One type of gaming device specifically within the scope of this invention is the video game gaming device which has a video screen located between and connected to two standing side surfaces.

C.

Retrofitability

The use of a support arm like those described herein creates a lever situation. The weight of the user on the extended support arm and gaming seat creates a rotational force which will tend to cause the gaming device to be rotated in a clockwise manner about the fixed end of the support arm. The counter balancing force required to offset the weight of the user on the seat depends on the mass of the gaming device itself, and how the machines are currently affixed to their supporting members. There are several ways of translating this force to prevent the gaming device from tipping over. One possibility is to use clamps to fasten the back end of the gaming device to the floor. Another possibility is to use weights in the bottom of the unit to counter balance the affect of the lever action exerted by the support arm. Other retrofitting options include use of a sleeve which would be fastened to the vertical surface of the sleeve rather than to the gaming device itself.

The installer of the retractable gaming device which is the subject of this invention must adapt the support arm device to whatever machine it is being affixed, paying careful attention to the possibility of the machine tipping over.

Another issue to be addressed when retrofitting any of the support arm embodiments is the possibility of interference with the internal mechanisms of the gaming device. The current design, utilizing either the fastening plate or the pivotal fastener, does not significantly intrude into the internal portions of the gaming device. The fastening plate embodiments spread the forces over a larger area in the immediate plane of the gaming device side surface, requiring a minimal intrusion into the inner space. The size of the plate utilized will depend upon the strength of the material which constitutes the gaming device side surface.

It is recognized that many of these problems will have to be addressed on a case by case basis when the retractable gaming device is retrofitted to existing equipment. It is to be appreciated, however, that when new machines are designed they can directly incorporate the retractable gaming device and the design requirements concerning the lever force and the intrusion into the internal mechanism space.

D.

Cylinders

All of the embodiments of the subject invention described herein require some type of pneumatic cylinder to accomplish a retraction or rotation. It is believed that all of these cylinders need to be specially designed for this purpose. There are special requirements of size and speed which are not addressed in the typical applications of pneumatic cylinders. As noted above, different speeds will be required to permit rotation of the seat before the retraction of the arm. The speed differentials can be introduced by the type of dampening fluid or vent sizes utilized in the cylinder. The strength of the spring inside the pneumatic cylinders also is related to the speed of retraction. However, commercially available cylinders may possibly be adapted to use if all of the above design criteria are met.

One alternative to pneumatic cylinder means for retracting the arms in the slide arm and bayonet type embodiments is to seal off the ends of the tubes and seal the receving points. This creates a dashpot wherein a spring can be used to provide the retracting force, but the sealed chamber provides the necessary dampening. The magnitude of this dampening can be controlled by the size of the vent valve at the fixed end of the arm. Additionally, an air inlet would have to be placed in the system.

Obviously the forms of the apparatus described herein constitute preferred embodiments of the invention; it is to be understood, however, that the invention is not limited to these precise forms of apparatus, and that changes may be made therein without departing from the scope of the invention.

I claim:

1. A retractable seat comprising:

(a) an elongate support arm comprising a plurality of hollow support bar sections, said sections having generally rectilinear cross sections and consecutive sections sized to permit one section to be received within the next said arm fastened at one end to a side vertical standing surface such that the longitudinal axis of said arm lies in a plane parallel to said vertical standing surface:

(b) a seat, and (c) means for pivotally joining said seat to the free end of said support arm such that said seat can be selectively positioned perpendicular to or parallel to said side vertical standing surface, whereby, when the support arm is fully extended, the seat can be selectively offset from the support arm to position the seat perpendicular to a front vertical standing surface.

2. The apparatus of claim 1 wherein said retractable seat further comprises locking means for maintaining said support arm in a fully extended position.

3. The apparatus of claim 1 wherein said retractable seat further comprises means for retracting said support bar sections generally along the longitudinal axis of said arm.

4. The apparatus of claim 1 wherein said retractable seat further comprises:

(a) means for retracting said hollow support bar sections generally along the longitudinal axis of said arm, and (b) locking means for maintaining said support arm in a fully extended position.

5. The apparatus of claim 1 wherein said seat joining means comprises:

(a) a hinge, one face of which is fastened to said support arm free end and the other face of which is fastened to said seat, and (b) pneumatic cylinder means, one end of which is pivotally attached to said support arm free end, and the other end is attached to a distal portion of said seat.

6. The apparatus of claim 1 wherein handle means is provided at the support arm free end for facilitating extension and retraction of said arm.

7. The apparatus of claim 1 wherein said side and front vertical standing surfaces are part of a gaming device.

8. The apparatus of claim 1 wherein said side and front vertical standing surfaces are part of a gaming device, the front surface being a gaming surface.

9. The apparatus of claim 1 wherein said side and front vertical surfaces are part of a video display device.

10. A retractable seat comprising:

(a) an elongate support arm comprising a plurality of hollow support bar sections, said sections having generally retilinear cross sections and consecutive sections sized to permit one section to be received within the next, said arm fastened at one end to side vertical standing surface such that the longitudinal axis of said arm lies in a plane parallel to said side vertical surface, (b) a seat, (c) a hinge, one face of which is fastened to said support arm free end and the other face of which is fastened to said seat, (d) first pneumatic cylinder means, one end of which is pivotally attached to said support arm free end and the other end of which is attached to a distal portion of said seat, (e) means for retracting said hollow support bar sections generally along the longitudinal axis of said arm, (f) locking means for maintaining said support arm in a fully extended position, and (g) linkage means for connecting said locking means to said seat such that said locking means is selectively activated when said support arm sections are extended and said locking means is released when said seat returns to a vertical position.

11. The apparatus of claim 10 wherein said retractable seat further comprises handle means provided at the support arm free end for facilitating extension and retraction of said support arm.

12. The apparatus of claim 10 wherein said side and front vertical surfaces are part of a gaming device, the front surface being a display surface.

13. The apparatus of claim 10 wherein said side and front vertical surfaces are part of a gambling device, the front surface being a display surface.

14. The apparatus of claim 10 wherein said side and front surfaces are part of a video display device, the front surface being a display surface.

15. A retractable seat comprising:

(a) an elongate support arm comprising a plurality of hollow support bar sections, said sections having generally circular cross sections and consecutive sections sized to permit one section to be slidably received within the next, said arm fastened at one end to a side vertical standing surface such that the longitudinal axis of said arm lies in a plane parallel to said side vertical surface;

(b) a seat, and (c) means for joining said seat to the free end of said support arm such that said seat can be selectively positioned perpendicular to, or parallel to, said side vertical standing surface.

16. The apparatus of claim 15 wherein said retractable seat further comprises means for retracting said hollow support bar sections generally along the longitudinal axis of said support arm.

17. The apparatus of claim 15 wherein said retractable seat further comprises locking means for maintaining said support arm in a fully extended position.

18. The apparatus of claim 15 wherein said retractable seat further comprises:

(a) means for retracting said hollow support bar sections generally along the longitudinal axis of said arm, and (b) locking means for maintaining said support arm in a fully extended position.

19. The apparatus of claim 13 wherein said means for joining said seat to the support arm free end for selective positioning comprises:

(a) means for rigidly fastening said seat to a distal support bar section; and (b) support arm cog means for selectively restricting movement of said distal support bar section relative to a previous bar section, generally in a direction of rotation about the longitudinal axis of said support arm, whereby in use said seat is selectively positioned by the rotation of said distal support bar section between substantially horizontal and vertical positions.

20. The apparatus of claim 15 wherein said retractable seat further comprises spring means which are positioned in an annular space between an intermediate and distal support arm sections such that said spring means will cause said distal section to rotate about its longitudinal axis thereby maintaining said seat in a vertical position when spring means are relaxed, and further thereby requiring a force applied against said spring means to move the seat to the horizontal position.

21. The apparatus of claim 15 wherein said side and front vertical standing surfaces are part of a gaming device, the front surface being a display face.

22. The apparatus of claim 15 wherein said side and front vertical surfaces are part of a gambling device, the front surface being a display face.

23. The apparatus of claim 15, wherein said side and front vertical surfaces are part of a video display device, the front surface being a display surface.

24. A retractable gaming seat comprising:

(a) an elongate support arm comprising a plurality of hollow support bar sections, said sections having generally circular cross sections and consecutive sections sized to permit one section to be slidably within the next, said arm fastened at one end to a side vertical standing surface such that the longitudinal axis of said arm lies in a plane parallel to said side vertical surface;

(b) a seat;

(c) means for fastening said seat to a distal support bar section;

(d) support arm cog means for selectively restricting movement of said distal support bar section relative to a previous bar section, generally in a direction of rotation about the longitudinal axis of said support arm;

(e) means for retrating said hollow support bar sections generally along the longitudinal axis of said support arm;

(f) locking means for maintaining said support arm in a fully extended position, when said seat is in a substantially horizontal position; and (g) spring operated release means for releasing said locking means when said seat is rotated towards a vertical position, and (h) spring means positioned in an annular space between an intermediate and distal support arm sections, such that said spring means will cause said distal section to rotate about its longitudinal axis, thereby maintaining said seat in a vertical position when not in use.

25. The apparatus of claim 24 wherein said distal support bar section further comprises handle means for facilitating extension and retraction of said support arm along its longitudinal axis.

26. The apparatus of claim 24 wherein said side and front vertical standing surfaces are part of a gaming device, the front surface being the gaming surface.

27. The apparatus of claim 24 wherein said side and front vertical surfaces are part of a gambling device, the front surface being a display face.

28. The apparatus of claim 24 wherein said side and front vertical surfaces are part of a video display device, the front surface being the display surface.

* * * * *